US009635906B2

(12) United States Patent
Midorikawa

(10) Patent No.: US 9,635,906 B2
(45) Date of Patent: May 2, 2017

(54) SHOELACE WINDING DEVICE

(71) Applicant: JAPANA CO., LTD., Nagoya, Aichi (JP)

(72) Inventor: Shinobu Midorikawa, Nagoya (JP)

(73) Assignee: JAPANA CO., LTD., Nagoya, Aichi (JP)

( * ) Notice: Subject to any disclaimer, the term of this patent is extended or adjusted under 35 U.S.C. 154(b) by 230 days.

(21) Appl. No.: 14/405,733

(22) PCT Filed: Oct. 17, 2013

(86) PCT No.: PCT/JP2013/078116
§ 371 (c)(1),
(2) Date: Dec. 4, 2014

(87) PCT Pub. No.: WO2014/203415
PCT Pub. Date: Dec. 24, 2014

(65) Prior Publication Data

US 2016/0262496 A1 Sep. 15, 2016

(30) Foreign Application Priority Data

Jun. 18, 2013 (JP) ..... 2013-127574

(51) Int. Cl.
*A43C 11/16* (2006.01)

(52) U.S. Cl.
CPC ..... *A43C 11/165* (2013.01)

(58) Field of Classification Search
CPC ..... A43C 11/16; A43C 11/165; A43C 11/00; A43C 11/004; Y10T 24/2183;
(Continued)

(56) References Cited

U.S. PATENT DOCUMENTS 4,433,456 A 2/1984 Baggio
5,042,177 A 8/1991 Schoch
(Continued)

FOREIGN PATENT DOCUMENTS

CN 1096572 12/1994
CN 103153112 6/2013
(Continued)

OTHER PUBLICATIONS 201380027473.4, Aug. 25, 2015, Chinese Office Action and English Translation.

*Primary Examiner* — Robert J Sandy
*Assistant Examiner* — Rowland Do
(74) *Attorney, Agent, or Firm* — Workman Nydegger

(57) ABSTRACT

A small-sized and light weighted shoelace winding device having superior durability, operability, and maintenance, and that can conveniently be used in various types of shoes is provided. A shoelace winding device includes a base member including a reel storing section for storing a shoelace winding reel, a shaft member for attaching a dial for rotatively driving the reel to the base member, and retaining and guiding the dial in a state of being movable between a lock position and a release position, and a spring member having one end portion axially supported by a bearing section of the shaft member, and its other end portion making constant contact with an engaging portion provided on an inner surface of the dial.

3 Claims, 4 Drawing Sheets

(58) Field of Classification Search
CPC . Y10T 24/4984; Y10T 24/2187; Y10T 24/37; Y10T 74/2133; B65H 75/4431
See application file for complete search history.

(56) References Cited

U.S. PATENT DOCUMENTS

| | | | | |
|---|---|---|---|---|
| 5,157,813 | A | 10/1992 | Carroll | |
| 5,325,613 | A | 7/1994 | Sussmann | |
| 5,606,778 | A | 3/1997 | Jungkind | |
| 5,934,599 | A | 8/1999 | Hammerslag | |
| 6,202,953 | B1 | 3/2001 | Hammerslag | |
| 6,289,558 | B1 | 9/2001 | Hammerslag | |
| 7,954,204 | B2 * | 6/2011 | Hammerslag | A43B 5/16 24/68 SK |
| 8,245,371 | B2 * | 8/2012 | Chen | A43C 7/00 24/68 B |
| 8,308,098 | B2 | 11/2012 | Chen | |
| 8,353,087 | B2 * | 1/2013 | Chen | A43C 11/165 24/68 SK |
| 8,468,657 | B2 * | 6/2013 | Soderberg | A43C 11/16 24/68 SK |
| 8,516,662 | B2 | 8/2013 | Goodman et al. | |
| 8,707,486 | B2 * | 4/2014 | Chella | A61F 5/0111 36/50.1 |
| 8,832,912 | B2 * | 9/2014 | Ha | A43C 11/165 24/68 B |
| 9,072,341 | B2 * | 7/2015 | Jungkind | A43C 11/165 |
| 9,101,181 | B2 * | 8/2015 | Soderberg | A43C 11/165 |
| 9,339,089 | B2 * | 5/2016 | So | A44B 99/00 |
| 9,364,054 | B2 * | 6/2016 | Gittens | A44C 5/22 |
| 9,375,053 | B2 * | 6/2016 | Burns | A43C 11/165 |
| 9,408,437 | B2 | 8/2016 | Goodman et al. | |
| 9,408,438 | B2 | 8/2016 | Chen | |
| 9,439,477 | B2 * | 9/2016 | Neiley | A43C 7/00 |
| 2002/0178548 | A1 | 12/2002 | Freed | |
| 2005/0247813 | A1 | 11/2005 | Kovacevich et al. | |
| 2006/0156517 | A1 | 7/2006 | Hammerslag et al. | |
| 2007/0169378 | A1 | 7/2007 | Sodeberg et al. | |
| 2009/0172928 | A1 | 7/2009 | Messmer et al. | |
| 2009/0184189 | A1 | 7/2009 | Soderberg et al. | |
| 2010/0101061 | A1 | 4/2010 | Ha | |
| 2010/0139057 | A1 | 6/2010 | Soderberg et al. | |
| 2010/0299959 | A1 | 12/2010 | Hammerslag et al. | |
| 2011/0167543 | A1 | 7/2011 | Kovacevich et al. | |
| 2011/0191992 | A1 | 8/2011 | Chen | |
| 2011/0266384 | A1 | 11/2011 | Goodman et al. | |
| 2012/0004587 | A1 | 1/2012 | Nickel et al. | |
| 2013/0025100 | A1 | 1/2013 | Ha | |
| 2014/0097283 | A1 | 4/2014 | So | |
| 2014/0117140 | A1 | 5/2014 | Goodman et al. | |
| 2016/0213099 | A1 | 7/2016 | Ha et al. | |

FOREIGN PATENT DOCUMENTS

| | | | |
|---|---|---|---|
| EP | 0056953 | | 11/1985 |
| EP | 0412290 | | 6/1994 |
| EP | 0651954 | A1 | 5/1995 |
| EP | 0625015 | | 7/1996 |
| JP | 54-108125 | U | 7/1979 |
| JP | 4171774 | B2 | 9/2001 |
| JP | 2009-504210 | | 2/2009 |
| JP | 2010-148927 | A | 7/2010 |
| JP | 4538836 | B2 | 7/2010 |
| JP | 2012-120679 | A | 6/2012 |
| JP | 2013-22467 | | 2/2013 |
| JP | 2013-525007 | | 6/2013 |
| WO | WO 99/09850 | A1 | 3/1999 |
| WO | WO 01/15559 | | 3/2001 |
| WO | WO 2005/013748 | A1 | 2/2005 |
| WO | WO 2006/050266 | A2 | 5/2006 |
| WO | WO 2010/059989 | A2 | 5/2010 |
| WO | WO 2010/059989 | A3 | 5/2010 |
| WO | WO 2011/137405 | A2 | 11/2011 |
| WO | 2012/165803 | | 12/2012 |

* cited by examiner

SHOELACE WINDING DEVICE

CROSS REFERENCE TO RELATED APPLICATIONS

This application is a U.S. Nationalization of PCT Application Number PCT/JP2013/078116, filed on Oct. 17, 2013, which claims priority to Japanese Patent Application No. 2013-127574, filed on Jun. 18, 2013, the entireties of which are incorporated herein by reference. This application is related to U.S. application Ser. No. 14/405,738, filed Dec. 4, 2014.

TECHNICAL FIELD

The present invention relates to a shoelace winding device that is suitable not only for boots for skiing, snowboarding, skating, mountain climbing, and biking, but also for sports shoes used in golf and jogging, and moreover suitable for tightening shoelaces of general shoes such as business shoes.

BACKGROUND ART

Conventionally, to tighten a boot shoelace used in skiing, snowboarding, skating and the like, a shoelace winding device that can tighten the shoelace by rotating a dial (disk-shaped tab) and release the tightening of the shoelace in a one-touch manner has been proposed (Patent Document 1).

In such a shoelace winding device, an operation to switch between a lock state in which the shoelace can be tightened by the dial and a release state in which the tightening of the shoelace can be released is enabled by slidingly moving a resin-made projection (indent washer) to engage with one of a "coupled recess" and a "uncoupled recess".

However, in such a shoelace winding device, the operation of riding over a "peak" between the "coupled recess" and the "uncoupled recess" is repeated by the slide movement of the projection, and there is a problem that the projection and the "peak" are worn to the extent that the switch between the lock state and the release state cannot be performed normally.

Furthermore, even in an embodiment in which a spring formed of steel wire is used instead of the projection, and the spring is moved between the "coupled recess" and the "uncoupled recess", the "peak" between the "coupled recess" and the "uncoupled recess" is worn, and there is a problem of insufficient durability and reliability.

Moreover, in such a shoelace winding device, size and weight reduction as well as simplification of an assembling work and a disassembling work upon repair are being required, and resolution of these problems is necessary in order to employ the shoelace winding device to an even greater variety of shoes.

CITATION LIST

Patent Literatures

Patent Document 1: JP 2010-148927 A

SUMMARY OF INVENTION

Technical Problem

Therefore, the present invention aims to solve the problem that, in the conventional shoelace winding device, damage is easily caused by the wear generated by repeating the operation to switch between the lock state in which the shoelace can be tightened and the release state in which the tightening of the shoelace can be released, and there is the need to use a large number of metal components and make resin components large in order to improve strength and durability. The purpose of the present invention is to provide a shoelace winding device that can improve the size and weight reduction as well as the durability and reliability, facilitate the assembling work and the disassembling work upon repair, has superior operability, and can be used in the even greater variety of shoes.

Solution to Problem

The primary feature of the present invention is a shoelace winding device comprising: a reel for winding a shoelace; a base member including a reel storing section for storing the reel; a dial for rotatively driving the reel, including a stopper member for realizing a lock state in which rotation of the dial can be transmitted to the reel and a release state in which the reel is disconnected from the dial so that the reel can rotate freely; a shaft member to be fixed to the base member to attach the dial to the base member, the shaft member being configured to retain and guide the dial in a state of being movable between a lock position where the dial is caused to approach the base member and a release position where the dial is separated away from the base member; and a spring member having its one end portion axially supported along a direction orthogonally intersecting an axial direction of the shaft member by a bearing section formed at a side portion of the shaft member, and having its other end portion making constant contact with an engaging portion provided on an inner surface of the dial. The shoelace winding device is configured to switch from a lock state of the reel to a release state by the dial moving from the lock position to the release position, an inversion position where the spring member is compressed the most is set at a position between the lock position and the release position, and a direction along which the spring member is compressed is switched between the lock position and the release position.

The stopper member may be fitted inside the dial and integrated with the dial, and the engaging portion where the other end portion of the spring member makes contact may be provided at an outer end narrowest portion of a spring storing space formed in a cuneate shape at a boundary portion between the dial and the stopper member.

The spring member may be assembled to the dial by the other end portion of the spring member being inserted into the spring storing space from an expanded portion where an axial hole of the dial is expanded, and further the other end portion being guided to be moved around from an inner end side of the spring storing space toward an outer end narrowest portion side when the spring member is inserted into axial holes formed on the dial and the stopper member.

Further, the spring member may be a spring member that is formed by being curved in a substantially U-shape, a linear-shaped shaft portion of the spring member on one end side may be axially supported along the direction orthogonally intersecting the axial direction of the shaft member by the bearing section formed at the side portion of the shaft member, and a curved spring portion on the other end side may make contact with the engaging portion.

Moreover, one spring member may be located at each of positions separated about 180 degrees apart on the shaft member.

Advantageous Effects of Invention

In the shoelace winding device of the present invention configured as above, the other end portion of the spring member having its one end portion axially supported by the bearing section of the shaft member fixed to the base member for mounting the dial, which rotatively drives the reel for winding the shoelace, to the base member, is in the state of making constant contact with the engaging portion provided on the inner surface of the dial upon the switching of the lock state and the release state of the dial.

Thus, since the positions where the components such as the dial is making contact with the spring member are not displaced while the dial moves from the lock position to the release position, the components such as the dial and the spring member can be prevented from being rubbed against each other thereby to wear out.

Moreover, since the inversion position where the spring member is compressed the most is set at the position between the lock position and the release position of the dial, a force to compress the spring member needs to be applied to move the dial from the lock position to the release position, so the dial can be prevented from inadvertently moving from the lock position to the release position.

Moreover, since the direction along which the spring member is compressed is switched between the lock position and the release position of the dial, a superior operability is obtained, and at the same time a state of the dial can clearly be understood.

A component having a complicated shape can easily be provided by configuring the stopper member to be fitted inside the dial and be integrated therewith. Further, by providing the engaging portion where the other end portion of the spring member makes contact at the outer end narrowest portion of the spring storing space formed in the cuneate shape at the boundary portion between the dial and the stopper member, accommodating performance of the spring member is excellent, reliability and durability of the device can be improved, and an operation range of the spring member can correctly be regulated.

The spring member is assembled to the dial in such a manner that the other end portion of the spring member is inserted into the spring storing space from an expanded portion where an axial hole of the dial is expanded, and further the other end portion is guided to be moved around from an inner end side of the spring storing space toward an outer end narrowest portion side when the spring member is inserted into axial holes formed on the dial and the stopper member. With this configuration, the assembly of the spring member can easily be performed simply by pressing in the spring member to the dial.

Further, the spring member is curvedly formed in a substantially U-shape. Its linear-shaped shaft portion on one end side is axially supported along the direction orthogonally intersecting the axial direction of the shaft member by the bearing section formed at the side portion of the shaft member. A curved spring portion on the other end side makes contact with the engaging portion. With this configuration, the spring member is enabled to rotatively move about the shaft portion.

Further, since the spring portion is curved, the spring portion and the engaging portion smoothly make contact upon when the spring member deforms by being compressed, whereby the deformation of the spring member can be performed smoothly.

That is, the compressing operation of the spring member can be performed smoothly, and the operability thereof can be made superior in changing the dial position.

Moreover, by positioning one spring member at each of the positions on the shaft member that are separated about 180 degrees apart, symmetry of the shaft member and the dial and the like can be obtained, whereby a balance of the shoelace winding device becomes superior, which contributes to the improvements of durability, reliability, operability, and maintenance performance.

DESCRIPTION OF EMBODIMENTS

The present invention is "a shoelace winding device comprising: a reel for winding a shoelace; a base member including a reel storing section for storing the reel; a dial for rotatively driving the reel, including a stopper member for realizing a lock state in which rotation of the dial can be transmitted to the reel and a release state in which the reel is disconnected from the dial so that the reel can rotate freely; a shaft member to be fixed to the base member to attach the dial to the base member, the shaft member being configured to retain and guide the dial in a state of being movable between a lock position where the dial is caused to approach the base member and a release position where the dial is separated away from the base member; and a spring member having its one end portion axially supported along a direction orthogonally intersecting an axial direction of the shaft member by a bearing section formed at a side portion of the shaft member, and having its other end portion making constant contact with an engaging portion provided on an inner surface of the dial, wherein the shoelace winding device is configured to switch from a lock state of the reel to a release state by the dial moving from the lock position to the release position, an inversion position where the spring member is compressed the most is set at a position between the lock position and the release position, and a direction along which the spring member is compressed is switched between the lock position and the release position", and can suitably be implemented by embodiments and the like to be described below.

Hereinbelow, an embodiment that implemented the shoelace winding device of the present invention in sports shoes will be described.

Figure 1:
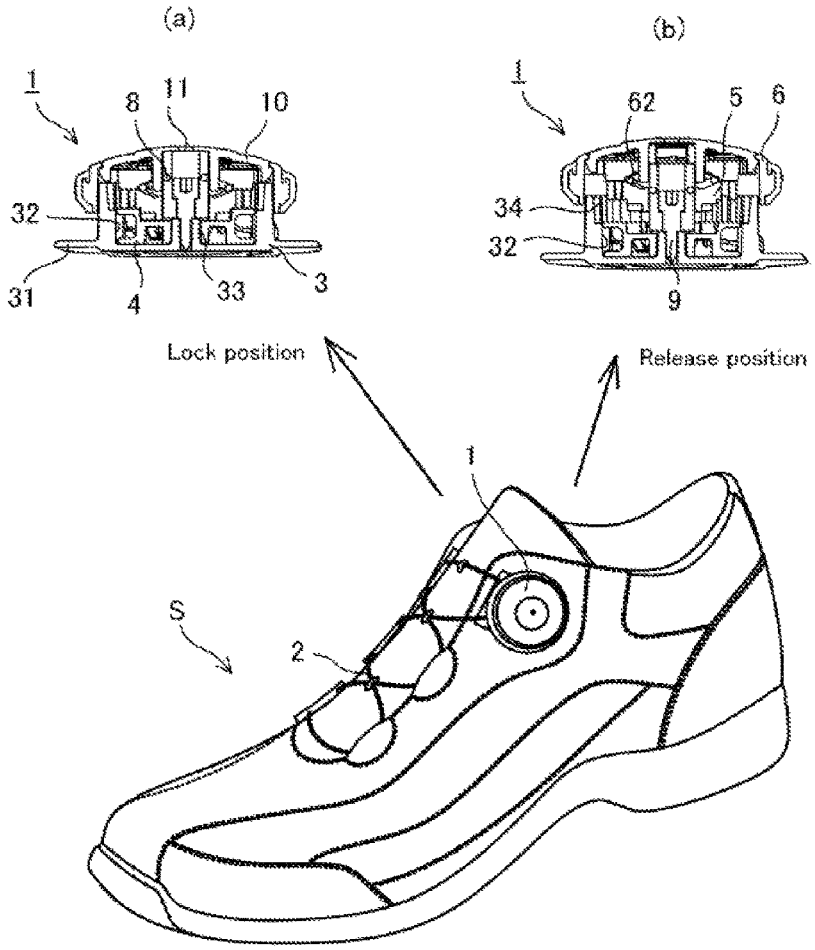
FIG. 1 is a perspective view of a shoe on which a shoelace winding device embodying the present invention is installed, and FIGS. 1(*a*) and 1(*b*) are cross sectional views of the shoelace winding device, where 1(*a*) shows a state in which a dial is in a lock position, and 1(*b*) shows a state in which the dial is in a release position.
Figure 2:
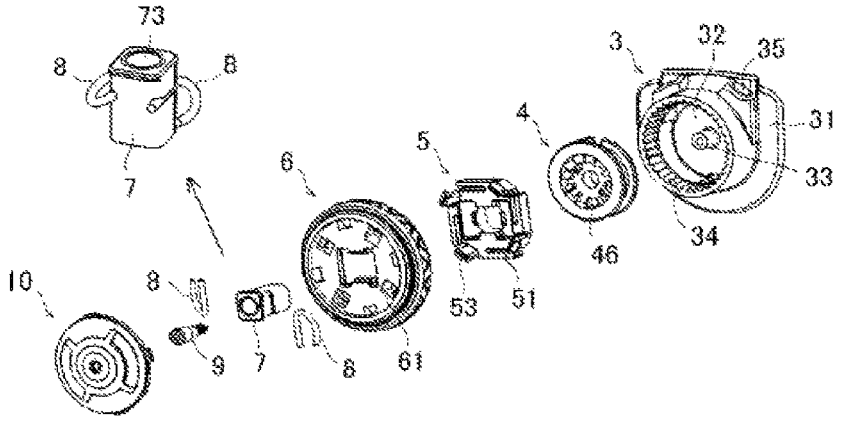
FIG. 2 is a perspective view of configurational components by disassembling the shoelace winding device embodying the present invention.
Figure 3:
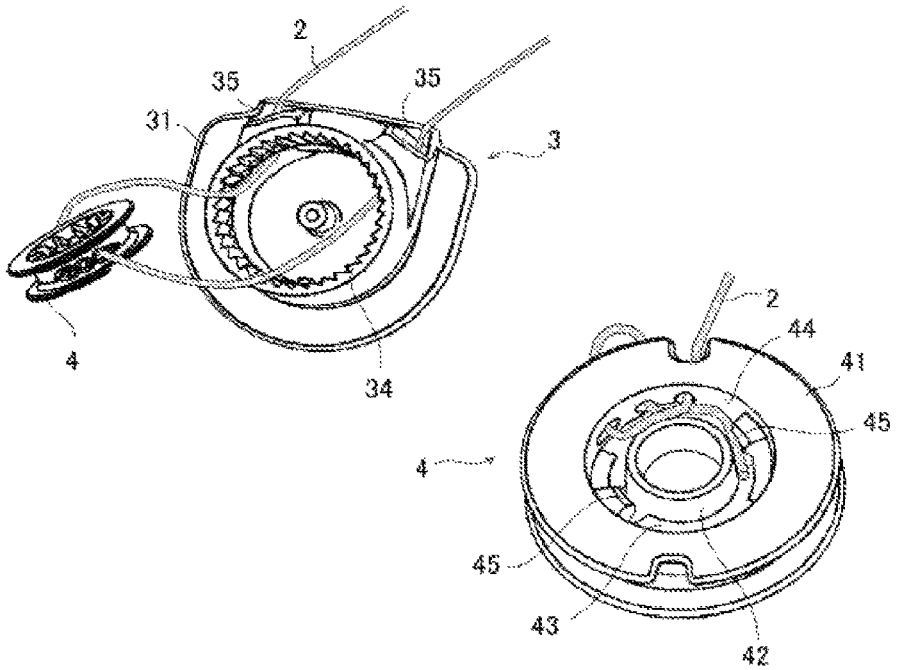
FIG. 3 is a perspective view of a base member and a reel of the shoelace winding device embodying the present invention.
Figure 4:
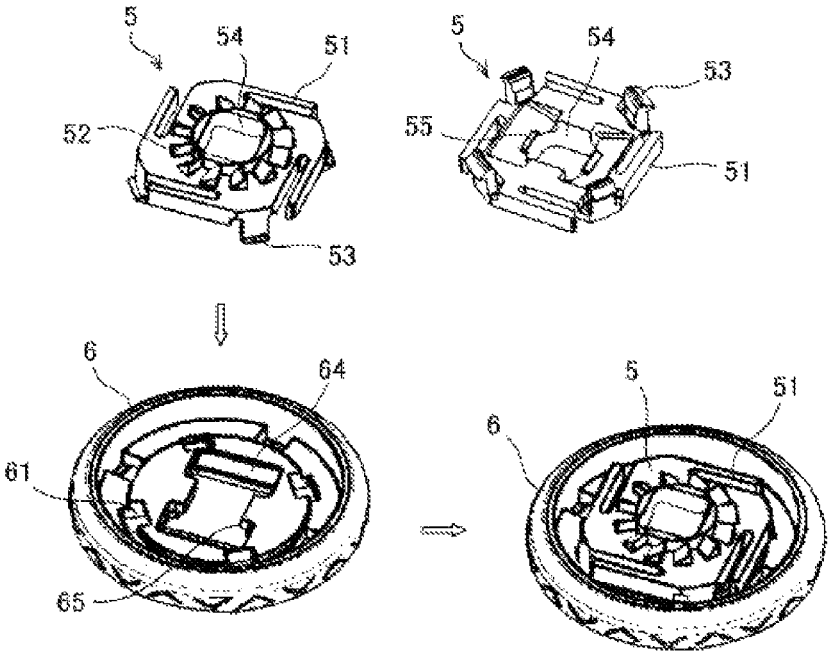
FIG. 4 is a perspective view of the dial and a stopper member of the shoelace winding device embodying the present invention.
Figure 5:
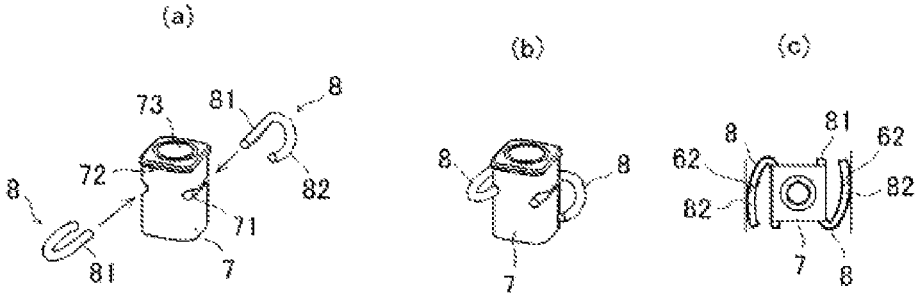
FIGS. 5(*a*) to 5(*c*) show a shaft member and a spring member of the shoelace winding device embodying the present invention, where 5(*a*) and 5(*b*) are perspective views, and 5(*c*) is a plan view.
Figure 6:
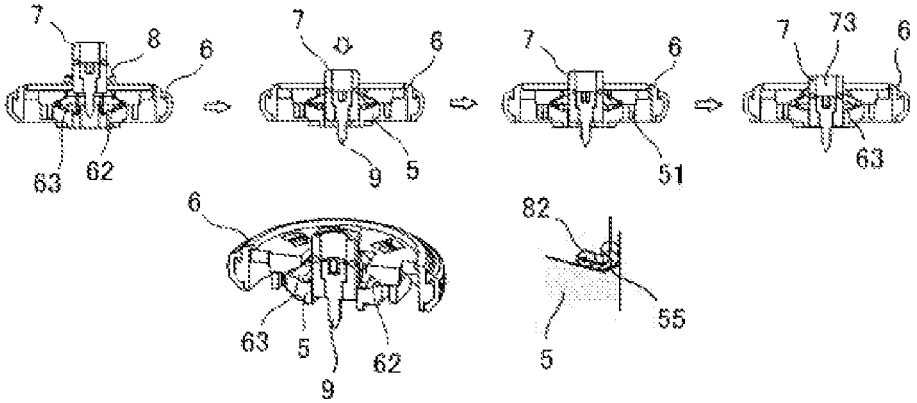
FIG. 6 is a cross sectional diagram showing a manner upon when the shaft member is assembled onto the dial of the shoelace winding device embodying the present invention.

FIG. 1 shows a shoelace winding device 1 according to the embodiment of the present invention, and a shoe S equipped with the shoelace winding device 1 at a position corresponding to an ankle, and this shoe S is configured such that an instep portion of the shoe S can be tightened by the shoelace 2 configured of a resin-coated metal wire.

The shoelace winding device 1 is configured of a base member 3, a reel 4 for winding the shoelace 2, a stopper member 5 for controlling rotation and stop of the reel, a dial 6 for rotatively driving the reel 4, a shaft member 7 to be rotatably fixed to the base member 3 for attaching the dial 6 and the stopper member 5 onto the base member 3, a spring member 8 having its one end portion axially supported by the shaft member 7, and the like.

The base member 3 can fix the shoelace winding device 1 to the shoe S by having a thin plate-shaped U-shaped flange 31 sewn onto the shoe S and fixed thereto, and includes a bottomed cylindrical-shaped reel storing section 32 for rotatably storing the reel 4.

The reel storing section 32 has a rotation shaft 33 for axially supporting the reel 4 projectingly formed at its bottom center, and a gear 34 is formed on an inner circumferential surface thereof.

The gear 34 configures a ratchet mechanism by cooperating with claws 51 formed on the stopper member 5, and has a cross section formed in a shape of "saw-teeth" so that the claws 51 can only move in a direction to wind the shoelace 2 (forward rotation).

Further, the base member 3 has shoelace draw-out openings 35 opened to a bottom of the reel storing section 32 and formed at two portions, and the shoelace 2 wound on the reel 4 can be drawn outside from the reel storing section 32.

The reel 4 includes a shoelace winding drum 41 for winding the shoelace 2, a rotation shaft portion 42 arranged on an inner side of the shoelace winding drum 41, an annular portion 43 connecting an inner circumferential surface of the shoelace winding drum 41 and an outer circumferential surface of the rotation shaft portion 42, and an annular groove portion 44 formed by the shoelace winding drum 41, the rotation shaft portion 42, and the annular portion 43.

The rotation shaft 33 of the base member 3 is inserted to an inner surface side of the rotation shaft portion 42, and the reel 4 is rotatable within the reel storing section 32.

The groove portion 44 of the reel 4 is arranged on a side facing the bottom of the base member 3 (hereafter referred to as a "lower side", and an opposite side thereof as an "upper side" for the sake of convenience of explanation), and engagement projections 45 for clamping a distal end of the shoelace 2 to be guided in the groove portion 44 from an outer circumferential surface side of the shoelace winding drum 41 and retaining the same in the groove portion 44 are provided within the groove portion 44.

A plurality of fins 46 is formed along the inner circumferential surface of the shoelace winding drum 41 on the upper side of the reel 4, and they can transmit the rotation of the dial 6 to the reel by meshing with fins 52 formed on the lower side of the stopper member 5.

The stopper member 5 is integrated with the dial 6 by engaging with an inner side (lower side) of the dial 6 with attachment claw portions 53 formed at its four corners being engaged with engagement holes 61 formed through the dial 6, and it can realize the lock state in which the rotation of the dial 6 can be transmitted to the reel 4 by being intervened between the reel 4 and the dial 6, and the release state in which the reel 4 is disconnected from the dial 6 so that the reel 4 can freely rotate.

The shaft member 7 is fixed to the base member 3 by a screw 9 so as to rotatably attach the integrated dial 6 and stopper member 5 onto the base member 3, and it can retain and guide the integrated dial 6 and stopper member 5 in a state of being movable between the lock position in which the integrated dial 6 and stopper member 5 are set close to the base member 3 and the release position in which they are separated from the base member 3.

The shaft member 7 is formed in a square column shape, and axially supports the spring members 8 in a rotatable manner by one end portion which is linear-shaped (a shaft portion 81) and is formed on the spring members 8 being inserted into bearing sections 71 formed by cutting out two opposing side portions of the shaft member in a direction orthogonally intersecting an axial direction of the shaft member 7. That is, the spring members 8 are arranged one each at positions of the shaft member 7 that are separated about 180 degrees apart.

Further, due to the shaft member 7 being in the square column shape, the strength of the bearing sections 71 can be increased, which can contribute to making the size of the shaft member 7 compact.

Moreover, the bearing sections 71 of the shaft member 7 are formed with their inner diameter in the vicinity of their center portions to be the smallest for easy separation from a mold.

Each spring member 8 has its entirety formed by being curved in a substantially U shape, and a curved spring portion 82 on the other end side makes contact with an engaging portion 62 provided on an inner surface of the integrated dial 6 and stopper member 5.

The engaging portion 62 where the other end portion (spring portion 82) of the spring member 8 makes contact is provided at an outer end narrowest portion of a spring storing space 63 formed in a cuneate shape at a boundary portion between the dial 6 and the stopper member 5.

Further, the reel 4 can be switched from a lock state to a release state by the integrated dial 6 and stopper member 5 being moved from the lock position to the release position.

Moreover, an inversion position L where the spring portions 82 of the spring members 8 are most compressed toward the shaft member side is set to be present at a position between the lock position and the release position.

A disk-shaped cap 10 is engaged with an upper side of the dial 6 so that dust and the like do not enter the inside of the shoelace winding device 1.

Meanwhile, a through hole 11 is formed at a center portion of the cap 10, and the reel 4, the dial 6, and the shaft member 7 can be disassembled from the base member 3 by operating the screw 9 within the inner side (lower side) of the cap 10 through this through hole 11.

As the wire-shaped shoelace 2 formed of a composite material of resin and metal, a wire rope in which 49 strings of stainless wires with a diameter of 0.11 to 0.13 mm are twisted that is processed by a swaging machine and coated by nylon resin can suitably be used.

Next, a method of manufacturing the shoelace winding device 1 described above by assembling the respective components will be described.

Firstly, in order to attach the reel 4 to the base member 3 of the shoelace winding device 1, tip ends of the shoelace 2 are inserted to the shoelace draw-out openings 35 provided at two positions, and the both ends of the shoelace 2 are drawn out from the reel storing section 32 side.

Then, the both ends of the shoelace 2 are fixed to the reel 4 by sequentially inserting the tip ends of the shoelace 2 into wire insertion holes 47 provided at six positions on the reel 4 in a sewing manner, and the reel 4 is arranged inside the reel storing section 32.

Next, the stopper member 5 and the dial 6 are integrated by engaging the stopper member 5 to the inner side (lower side) of the dial 6, and the shaft member 7 and the spring members 8 are assembled thereto.

In this case, the shaft member 7 is inserted into a substantially square-shaped axial hole 64 formed in the dial 6 and a substantially square-shaped axial hole 54 formed in the stopper member 5, whereas the spring portions 82 of the spring members 8 are inserted into spring storing spaces 63 from expanded portions where the axial hole 64 of the dial 6 is expanded, and moreover each spring portion 82 is guided to rotatingly move to the outer end narrowest portion side from the inner end side of the spring storing space 63, and is assembled to the dial 6.

Meanwhile, a flange 72 formed at an upper end portion of the shaft member 7 makes contact with an engaging step portion 65 formed at an edge of the axial hole 64 of the dial 6, whereby the dial 6 does not come off from the shaft member 7.

The spring portions 82 of the spring members 8 being guided to rotatingly move from the inner end side of the spring storing spaces 63 toward the outer end narrowest portion side is realized because an angled surface 55 facing an upper side (dial side) is formed at an edge of the axial hole 54 of the stopper member 5.

After having assembled the stopper member 5, the dial 6, the shaft member 7, and the spring members 8 by the above procedures, the screw 9 is inserted into a screw insertion hole 73 penetratingly formed along an axis of the shaft member 7, and the shaft member 7 and the other parts are attached to the base member 3.

The shoelace winding device 1 can be assembled by fitting the cap 10 onto the dial 6 at last.

In disassembling the shoelace winding device 1 for maintenance or repair, a screwdriver is inserted from the through hole 11 of the cap 10 and the screw 9 is taken off, whereby the stopper member 5, the dial 6, the shaft member 7, and the spring members 8 that were assembled can be taken off from the base member 3.

As cases where the maintenance or repair is necessary, a case where the shoelace 2 has been torn and a case where the shoelace 2 is entangled within the reel storing section 32 are most likely to happen, so being able to disconnect the stopper member 5, the dial 6, the shaft member 7, and the spring members 8 while they are being assembled from the base member 3 is very effective in improving the efficiency of the maintenance or repair work.

Meanwhile, as materials configuring the respective components in the shoelace winding device 1 of the present embodiment, the followings were used as an example in consideration of their strength, durability, elasticity and the like; however, materials are not limited thereto.

Base member 3: Nylon

Reel 4, stopper member 5, and shaft member 7: POM (polyacetal)

Dial 6: Nylon and TPE (thermoplastic elastomer) at a periphery thereof

Spring members 8: Stainless steel

Screw 9: Carbon steel

Cap 10: ABS resin

A method of use of the shoelace winding device 1 configured as above will be described.

In order to tighten the shoelace 2 after the shoe S is put on, the dial 6 of the shoelace winding device 1 is operated to rotate at the lock position where the dial 6 is caused to approach the base member 3, and the shoelace 2 is wound on the reel 4 thereby.

In this case, the reel 4 does not rotate in a direction with which the shoelace 2 is loosened by the claws 51 of the stopper member 5 making contact with the gear 34.

Figure 7:
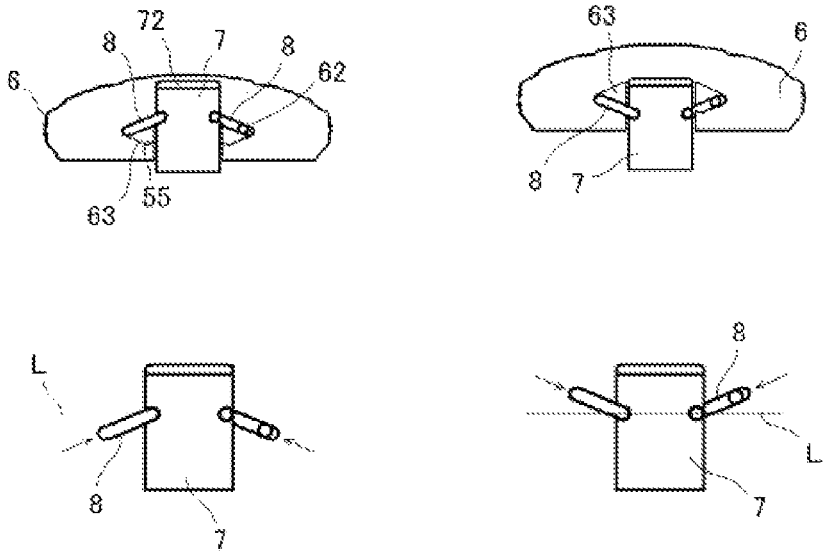
FIG. 7 is a side diagram showing a positional relationship of the dial and the shaft member, and a manner upon when the spring member rotates of the shoelace winding device embodying the present invention.

Further, since the inversion position L where the spring members 8 are compressed the most is set at the position between the lock position and the release position, the spring members 8 are in the state shown in left side of FIG. 7 when the dial 6 is in the lock position, wherein the dial 6 is retained in the lock position.

At this occasion, the spring members 8 are oriented in a direction along which the shaft member 7 is lifted and the dial 6 is pressed down.

Next, in order to loosen the tightened shoelace 2, the dial 6 of the shoelace winding device 1 is pulled to the upper side.

At this occasion, the spring members 8 are compressed, and by further pulling the dial 6 to the upper side against the repelling force thereof, the spring members 8 go beyond the inversion position L where they are compressed the most, the direction toward which the spring members 8 are compressed switches between the lock position and the release position, whereby the dial 6 is moved to the release position separated away from the base member 3 (state shown in right side of FIG. 7).

At this occasion, the spring members 8 are oriented in a direction along which the shaft member 7 is pressed down and the dial 6 is lifted.

The other end portions (spring portions 82) of the spring members 8 are making constant contact with the engaging portions 64 provided on the inner surface of the dial 6, whereby the wear of the components can be prevented.

Meanwhile, "making constant contact" is employed to improve the reliability, durability, and operability of the shoelace winding device 1 and omit fluctuation of the dial 6, and it does not intend to exclude the presence of some "play", so long as it does not affect the operation of the shoelace winding device 1.

Since the spring members 8 switch clearly between the lock position and the release position, not only the operability is improved, but also it is easy to understand the state of the position where the dial 6 resides.

As above, when the dial 6 moves from the lock position to the release position, engagement between the fins 46 of the reel 4 and the fins 52 of the stopper member 5 is released, whereby the reel 4 becomes freely rotatable, and the shoelace 2 is loosened thereby.

By contrast, if the dial 6 is pressed down so as to move from the release position to the lock position, the spring members 8 go, in the opposite direction, beyond the inversion position L where they are compressed the most, and the fins 46 of the reel 4 and the fins 52 of the stopper member 5 again engage with one another; thus the shoelace 2 can be tightened by winding the shoelace 2 onto the reel 4.

Meanwhile, in the description, a shape of the "dial" is not specifically limited so long as it functions as an operating section for rotatively driving the reel 4, and it may have a polygonal shape.

The present invention is not limited to the shoelace winding device 1 for tightening the shoelace 2 arranged as in the configuration shown in the drawings, and may be embodied in a shoelace winding device for tightening a shoelace 2 which tightens a different portion of the shoe S.

Furthermore, implementations can be made while suitably making changes to materials, shapes, dimensions, angles, arranged positions, sizes, numbers and the like of the respective parts of the shoelace winding device.

INDUSTRIAL APPLICABILITY

The present invention is small-sized and light weight, has superior durability, operability, and maintenance, and can suitably be used as a shoelace winding device that can conveniently be used in various types of shoes.

REFERENCE SIGNS LIST

1 Shoelace Winding Device
2 Shoelace
3 Base Member
31 Flange
32 Reel Storing Section
33 Rotation Shaft
34 Gear
35 Shoelace Draw-out Opening
4 Reel
41 Shoelace Winding Drum
42 Rotation Shaft Portion
43 Annular Portion
44 Groove Portion
45 Engagement Projection
46 Fin
47 Wire Insertion Hole
5 Stopper Member
51 Claw
52 Fin
53 Attachment Claw Portion
54 Axial Hole
55 Angled Surface
6 Dial
61 Engagement Hole
62 Engaging Portion
63 Spring Storing Space
64 Axial Hole
65 Engaging Step Portion
7 Shaft Member
71 Bearing Section
72 Flange
73 Screw Insertion Hole
8 Spring Member
81 Shaft Portion (one end portion)
82 Spring Portion (the other end portion)
9 Screw
10 Cap
11 Through Hole
S Shoe
L Inversion Position

The invention claimed is:

1. A shoelace winding device comprising:

a reel for winding a shoelace;

a base member including a reel storing section for storing the reel;

a dial for rotatively driving the reel, including a stopper member for realizing a lock state in which rotation of the dial can be transmitted to the reel and a release state in which the reel is disconnected from the dial so that the reel can rotate freely;

a shaft member to be fixed to the base member to attach the dial to the base member, the shaft member being configured to retain and guide the dial in a state of being movable between a lock position where the dial is caused to approach the base member and a release position where the dial is separated away from the base member; and a spring member having its one end portion axially supported along a direction orthogonally intersecting an axial direction of the shaft member by a bearing section formed at a side portion of the shaft member, and having its other end portion making constant contact with an engaging portion provided on an inner surface of the dial, wherein the shoelace winding device is configured to switch from a lock state of the reel to a release state by the dial moving from the lock position to the release position, an inversion position where the spring member is compressed the most is set at a position between the lock position and the release position, and a direction along which the spring member is compressed is switched between the lock position and the release position, wherein:

the stopper member is fitted inside the dial and integrated with the dial, the engaging portion where the other end portion of the spring member makes contact is provided at an outer end narrowest portion of a spring storing space formed in a cuneate shape at a boundary portion between the dial and the stopper member, and the spring member is assembled to the dial by the other end portion of the spring member being inserted into the spring storing space from an expanded portion where an axial hole of the dial is expanded, and further the other end portion being guided to be moved around from an inner end side of the spring storing space toward an outer end narrowest portion side when the spring member is inserted into axial holes formed on the dial and the stopper member.

2. The shoelace winding device according to claim 1, wherein:

the spring member is a spring member that is curvedly formed in a substantially U-shape;

a linear-shaped shaft portion of the spring member on one end side is axially supported along the direction orthogonally intersecting the axial direction of the shaft member by the bearing section formed at the side portion of the shaft member; and a curved spring portion on the other end side makes contact with the engaging portion.

3. The shoelace winding device according to claim 1, wherein one spring member is arranged at each of positions on the shaft member that are separated about 180 degrees apart.

* * * * *